United States Patent [19]

Rowland

[11] 4,090,844

[45] May 23, 1978

[54] PROCESS OF PRODUCING HIGH PERFORMANCE DURABLE-PRESS COTTON

[75] Inventor: Stanley P. Rowland, New Orleans, La.

[73] Assignee: The United States of America as represented by the Secretary of Agriculture, Washington, D.C.

[21] Appl. No.: 809,356

[22] Filed: Jun. 23, 1977

[51] Int. Cl.[2] ..... D06M 13/24

[52] U.S. Cl. ..... 8/120; 8/183; 8/184; 8/185; 8/190

[58] Field of Search ..... 8/120, 183, 185, 184, 8/190

[56] References Cited

U.S. PATENT DOCUMENTS

| | | | |
|---|---|---|---|
| 3,451,763 | 6/1969 | Weiss | 8/115.7 |
| 3,572,988 | 3/1971 | Sumrell et al. | 8/120 |
| 3,708,261 | 1/1973 | Kasper et al. | 8/120 |
| 3,709,657 | 1/1973 | Hollies et al. | 8/120 |
| 3,817,702 | 6/1974 | Paulus et al. | 8/120 |
| 3,868,216 | 2/1975 | Franklin et al. | 8/182 |
| 3,897,206 | 6/1975 | Kearney | 8/120 |
| 3,909,195 | 9/1975 | Machell et al. | 8/115.7 |

OTHER PUBLICATIONS

Chemical Modification of Cotton by Reaction with Activated Olefinic Compounds, Textile Research Journal, pp. 92–98, Feb. 1957.

*Primary Examiner*—John Kight, III
*Attorney, Agent, or Firm*—M. Howard Silverstein; David G. McConnell; Salvador J. Cangemi

[57] ABSTRACT

Wrinkle resistance, soil release, improved breaking strength and abrasion, and durable deodorant (bacteriostatic) quality are a plurality of useful properties imparted to cotton by a process with chemicals which include polyfunctional crosslinking compounds, zinc salts of polymerizable acrylic-type acids, and basic persulfates. The fabric is impregnated, heat-fixed, and cured by conventional methods and employing conventional equipment.

6 Claims, No Drawings

PROCESS OF PRODUCING HIGH PERFORMANCE DURABLE-PRESS COTTON

BACKGROUND OF THE INVENTION

1. Field of the Invention

This invention relates to improving the physical and bacteriological properties of cotton and cellulose-containing textiles. More specifically this invention relates to the products and the process of imparting a plurality of improvements to cellulosic textiles by chemical means, and heat treatment.

2. Description of the Prior Art

It is well known to impart durable wrinkle resistance to cellulosic fabrics such as cotton by impregnation with an aqueous solution of a suitable thermosetting resinuous precondensate or cellulose crosslinking agent, usually with an appropriate catalyst, and eventually curing of the impregnated fabric. Such treatments have been effective in improving the wrinkle resistance and the shape holding properties of cotton fabrics and have resulted in greatly increased demand for "easy-care," "wash-and-wear," and "permanent-press" cotton fabrics because they combine traditional comfort, washability, and economy of native fibers with easy care properties that are desired in todays textile market.

A variety of processes has been developed and used for improving wrinkle resistance or recovery of fabrics and garments. These processes are known in general as pad-dry-cure resin treatments, where one or more resins are applied to the fabrics through padding, and the fabrics are partially dried before the resin is cured.

The conventional thermosetting resin systems, either post cured and precured, result in embrittlement and reduction of mobility of the cellulosic fibers to such an extent that tearing strength, breaking strength and abrasion resistance are seriously impaired. Tear strength is often reduced by 50%, breaking strength by 50–60%, and abrasion resistance by 75–85%.

Over the last several years, considerable research has been conducted to find ways of overcoming this problem without compromising the wash-wear or durable-press performance of the fabric. Many variations from the pad-dry-cure process have been developed in attempts to solve the problem. These include processes involving a multi-stage padding and curing, processes involving a pad and wet-fixation prior to cure, and processes involving polymeric additives. The results achieved through all of these processes have been marginal, and the processes have often been found to be cumbersome and expensive.

A particular and promising approach to the production of easy-care, durable-press fabrics has involved the wet fixation of resin-forming crease-proofing agents such as formaldehyde-melamine precondensates, as disclosed in Textile Research Journal 37, 70 (1967) and in U.S. Pat. No. 3,138,802. In this type of process, the fiber system such as a cotton fabric is protected against an excessive strength loss by fixation of a suitable resin forming and creasing proofing agent within the fibers while they are wet and swollen. In the laboratory process, the fabric, padded with the solution of the reagents at a pH of 2, is heated in a moist atmosphere to achieve fixation of the N-methylol reagents. Part of the resin contact is firmly fixed in the cotton fibers and the fabric at this stage; after rinsing and introduction of catalyst and softener, the fabric can be cured immediately or stored prior to cure at elevated temperature. Wet fixation processes have generally been cumbersome, or have required special equipment and processing.

The use of nonreactive or coreactive additives for the purpose of obtaining improved abrasion resistance in durable-press fabrics is discussed in Textile Research Journal 37, 253 (1967). This type of approach is exemplified in U.S. Pat. No. 3,877,872 which calls for the inclusion of tetraethylene glycol dimethyl ether in a conventional reagent bath consisting of methylated methylolmelamine and a crosslinking agent, such as dimethyloldihydroxyethyleneurea, and a catalyst such as zinc nitrate or magnesium chloride. This same patent illustrates, also, the introduction of an aqueous emulsion of polyurethane to fabric in a separate step to develop a fiber coating that enhances abrasion resistance. In general, the benefits are less than desired from such modifications of conventional crosslinking treatments.

In U.S. Pat. No. 3,306,992 there is described a method for treating cotton-containing fabric for obtaining improved wrinkle-resistance and improved abrasion resistance which involves padding the fabric through a resin finishing bath containing a mixture of a conventional thermosetting resin in combination with a latex emulsion prior to a subsequent drying step, and a final curing at elevated temperature. In this case the additive is a synthetic rubber latex, which consists of a carboxy-modified butadiene-styrene copolymer in emulsion form. This preformed polymer undergoes some reaction with the resin-forming reagent to produce a coating on fabric, yarn, and fiber surfaces.

U.S. Pat. No. 3,311,496 describes a process that involves pretreatment of fabric with hardenable aminoplasts by the wet steam process before treatment with a creaseproofing hardenable aminoplast. At a given level of wrinkle recovery, the tensile strength of the product is significantly higher than that of the unpretreated fabric. U.S. Pat. No. 2,992,138 teaches to overcome adverse effects upon tensile strength of fabric caused by zinc nitrate catalyst employed with dimethylolethyleneurea by introducing an alkali metal acetate into the reagent mixture. U.S. Pat. No. 3,402,988 achieves improved abrasion resistance and other properties by first impregnating fabric with conventional wash-wear formulations and second applying a catalyst deactivator on the top and bottom of the fabric, so that superior properties are retained in the surface areas. According to U.S. Pat. No. 3,634,019 high strength losses in cellulosic fabrics when treated with creaseproofing agents to produce durable-press properties are avoided by eliminating a major part of the usual acidic catalyst and adding an amount of zinc or aluminum acetate. In U.S. Pat. No. 3,807,952, there is a method described for improving abrasion resistance in crosslinked cellulosic fibers which amounts to introducing salt additives to the conventional reagent system. U.S. Pat. No. 3,827,994 refers to imparting abrasion resistance and permanent press properties to cellulosic materials by employing N-methylol-lactamide in conjunction with other conventional N-methylol reagents. U.S. Pat. No. 3,526,474 describes a process for imparting abrasion resistance and wrinkle resistance and durable-press properties to cellulosic fibers by first applying the N-methylol reagent and subjecting it to curing conditions in the presence of a so-called polymerization catalyst and later impregnating the treated fabric with an acid latent catalyst, drying and finally curing. U.S. Pat. No. 3,656,885 achieves improvement in wear resistance of cotton fabrics in wash-wear or durable-press garments by sequential separate steps of swelling, substitution, and cross-linking of fabric and, more specifically, by applying to cotton pairs of monofunctional and polyfunctional reactive swelling agents.

In the above-cited prior art and in conventional processes for development of easy-care or durable-press properties in cotton fabrics, the N-methylol resins reduce the hydrophilic characteristics of the original cotton fiber, and this is further accentuated and aggravated by the introduction of supplementary additives. The results is that the hydrophilic characteristics of the cotton are further reduced. Since the cotton fiber is unique among major textile fibers for apparel in its hydrophilic characteristics, it is undesirable that these be lost; in general, reduction in the hydrophilic characteristics of cotton results in decreased comfort to a wearer and decreased soil removal during laundering. The removal of oily soil constitutes a special problem for durable-press cotton fabrics and an even greater problem for durable-press cotton/polyester fabrics.

There is an increasing need for inhibition of microbiological growths on fabric for several reasons, including the reduction in persistence of virus on fabric, reduced transmission of infection by means of fabric, reduction or prevention of perspiration odor on fabrics, for which *Staphylococcus aureus* and *Stephylococcus epidermidis* are primary contributors (R. W. Sidwell, G. J. Dixon, and E. McNeil, Applied Microbiology 14, 55 (1966); E. McNeil, J. M. Blanford, E. A. Choper, et al., American Dyestuff Reporter 52, P1010 (1963); P. J. Radford, American Dyestuff Reporter 62 (11) 48 (1973); T. L. Vigo, G. F. Danna, and C. M. Welch, Carbohydrate Research 44, 45 (1975). Some fundamentals of antibacterial finishing have been discussed by Gagliardi (American Dyestuff Reporter 51, P49 (1962) and Radford (see above) and some finishes for fabric have been described by Gagliardi, by McNeil et al., by Radford, and by Vigo et al. (foregoing references). Gagliardi (above ref.) described a variety of types of finishes for antibacterial activity, most of which (excepting those finishes containing mercury, tin, and silver) showed little activity remaining after 10 launderings and none of which combined antibacterial activity with other desirable properties, such as muss resistance and easy-care, oily soil release, or high retentions of strength and abrasion resistance.

SUMMARY OF THE INVENTION

This invention provides a chemical process for imparting to cellulosic textiles wrinkle resistance together with retention of high levels of strength and abrasion resistance, retention of hydrophilic characteristic of the cotton, especially with regard to levels of the release of oily soil during laundering, and antibacterial performance simultaneously with easy-care performance.

These qualities are achieved by applying to the cellulosic textile an aqueous solution containing three ingredients. The first ingredient consists of at least one water-soluble crosslink-forming compound possessing reactive methylol groups, the second ingredient consists of at least one zinc salt of a polymerizable acrylic-type acid, and the third ingredient consists of at least one water-soluble basic persulfate initiator, preferably ammonium or alkali metal persulfate. The textile is exposed in a water-swollen or dry state to an elevated temperature for a heat-fixation treatment which partially achieves a reaction of the chemicals with the fabric. The heat-fixed textile is then subjected to a second, more elevated temperature to achieve a cure.

Accordingly, a primary object of the present invention is to provide a process for improving the wrinkle resistance and smooth drying characteristics of cellulosic fiber-containing materials which process substantially prevents or alleviates the problems of the prior art discussed above.

Another object of the present invention is to provide a process for achieving a favorable balance between easy-care and abrasion resistance of cellulosic fiber-containing materials.

Yet another object or the present invention is to provide a process for improving the hydrophilic characteristics of easy-care or durable-press cotton fabrics and cotton-containing fabrics, especially insofar as improvement of the release of oily soil from the fabric is concerned.

Still another object of the present invention is to incorporate into the easy-care or durable-press finish an agent which confers antibacterial activity to the fabric.

Other and further objects of the invention will be obvious upon an understanding of illustrative embodiments about to be described, or will be indicated in the appended claims and various advantages not referred to herein will occur to one skilled in the art upon employment of the invention in practice.

DESCRIPTION OF THE PREFERRED EMBODIMENTS

The present invention is useful for treating various natural or artificial cellulosic fibers alone or as mixtures with each other in various proportions or as mixtures with other fibers. They include natural cellulosic fibers such as cotton, linen, and hemp, and in addition, regenerated or artificial cellulosic fibers such as the various types of rayon. Other fibers may be used in blends with one or more of the above mentioned cellulosic fibers; these supplementary blend fibers may be wool, silk, cellulose, acetate, polyamides, polyesters, acrylics, polyurethanes, polyvinyl chloride, polyvinylidene chloride, and polyvinyl alcohol fibers. The preferred percentages of cellulosic fibers are upwards from 30%.

The material may be knit, woven, nonwoven or otherwise constructed fabric or the invention may be applied to fibers or yarns before they are converted into the complex structures.

We have now discovered that cellulosic fiber-containing materials may be impregnated with aqueous solutions of conventional methylol crosslinking reagent, a zinc salt or a vinyl-polymerizable, water-soluble monomer, and a free radical initiator, cured with or without prior drying, and that the resulting fibers or textile product has high resilience (wrinkle recovery angle and smooth drying properties), high retentions of strength and abrasion resistance, high levels of antibacterial activity, and high levels of release of oily soil. The essence of this discovery may be stated as follows: durable-press fabrics characterized by high levels of retentions of strength and abrasion resistance, by durable antibacterial activity, and by oily soil release may be produced by reacting cellulosic textile products with combinations of methylol reagents, zinc salts of acrylic-type monomers, and inorganic persulfates. In this regard, foregoing terms may be defined as follows: durable press (as applied to cellulosic fabric) is defined as high wrinkle resistance, good smooth-drying appearance, and excellent retention of shape as measured primarily by wrinkle recovery angle and durable-press appearance rating. Durable-press properties are generally imparted to cellulosic fabrics by reactions which form crosslinks in the cellulosic fiber. Antibacterial activity may be defined as an action that emanates from the fibers or fabric and retards, inhibits, or reverses microbiological growth on or in the vicinity of the fibers of fabric; it may be measured by the Parallel Streak Test and by the modified Quinn Test, the former being a qualitative test and the later a quantitative test. Oily soil release is defined as the ease with which the soil imparted to fabric by an oily particulate material may be removed during standard laundering procedures; the appropriate test for measuring the release of oily soil makes use of used motor oil as the soiling agent and a conventional washing procedure for the removal of the soil. Retention of strength is measured on experimentally-treated samples and compared to strength of the modified fabric; in this connection, breaking strength and tearing strength are measured in the conventional manner. Retention of abrasion resistance also involves a comparison of the results obtained on the experimentally-treated fabric relative to those obtained on the initial, unmodified fabric; tests appropriate for the estimation of abrasion resistance are the Stoll flex abrasion resistance test and the Accelerator weight loss test.

In the process of the invention, the methylol reagent may serve the usual function, i.e., that of undergoing etherification reactions with the cellulosic substrate for formation of crosslinks and development of resilience. The zinc acrylate-type monomer appears to contribute the unique features to the chemically-modified fabrics that are described herein; this component serves as a means for introducing carboxylic functionality and zinc cations, which are the basis for antibacterial activity, for oily soil release, and for high retentions of strength and abrasion resistance. The persulfate initiator supplies a source of free radicals, which cause the vinyl monomer to undergo polymerization within the cotton fiber; it is surprising, however, that this same free-radical initiator and/or the zinc monomer are adequate to promote the etherification reaction of the methylol reagent with cellulose without necessity for introduction of a conventional salt or acid-generating catalyst. Methylenebisacrylamide may be applied advantageously in some respects in connection with the foregoing reagents; this water-soluble difunctional vinyl monomer may be introduced to contribute to durability of the vinyl polymer over the life time use of the fabric. It constitutes an optional, although sometimes desirable, addition to the reagent system. Supplementary components may be introduced into the reagent system for conventional purposes; such supplementary materials include wetting agent; softening agent (commonly an emulsion of a low-molecule weight polyethylene), water-soluble ion exchange resins (to complex heavy metals in the water), etc.

A specific example of a preferred embodiment of the bath is as follows:

| FORMULA OF FINISHING BATH | |
|---|---|
| Chemical Component | Percentage by weight |
| Polyfunctional N-methylol reagent | 4–12 |
| Zinc acrylate-type monomer | 1–10 |
| Persulfate initiator | 0.5–2.0 |
| Methylenebisacrylamide | 0–1.0 |
| Supplementary components* | (usually 210) |

-continued

| FORMULA OF FINISHING BATH | |
|---|---|
| Chemical Component | Percentage by weight |
| Water | To bring total to 100 |

*Such as wetting agent, softening agent, and heavy-metal complexing agent.

The polyfunctional N-methylol reagent may be one of the number of conventional methylol crosslinking reagents used for finishing cellulosic fabrics. The preferred reagent is dimethyloldihydroxyethyleneurea, but other reagents which also may be used include methylated methylol melamines, methylated urea-formaldehyde reagents, methylolated carbamates, formaldehyde, methylol urons, dimethylolethyleneurea, dimethylolpropyleneurea, and methylol triazones.

The vinyl-polymerizable, water-soluble zinc monomer salt is preferably a zinc salt of acrylic acid, methacrylic acid, or itaconic acid. It is preferred that the unsaturation be present on a terminal group and that it is conjugated with the carbonyl, as illustrated by these examples. The persulfate initiator may be selected from among the various inorganic salts of persulfuric acid, preferably ammonium persulfate, sodium persulfate, and potassium persulfate. Other free-radical generators, such as hydrogen peroxides, organic peroxides, or high energy irradiation are inadequate for the purpose of this invention since they do not activate reaction of the N-methylol reagent with cellulose. Methylenebisacrylamide, although not critical to the operation of this invention, may be advantageously employed under certain circumstances. Depending upon the specific situation, it may be desirable to introduce conventional agents that are employed in textile finishing for specific purposes; for example small amounts of wetting agent are advantageous in most cases where speed of wetting is an important factor; softening agents, exemplified by emulsions of low-molecular weight polyethylenes, are beneficial in the conventional manner of providing a pleasant hand to the fabric.

After the cellulosic textile is impregnated with the reagents solution, it may be stored in the wet state or subjected to a fixation process before it is dried. The impregnated and dried textile may be cured immediately or may be stored before it is cured. The curing step consists of a high temperature treatment carried out in an oven or in an apparatus which supplies a controlled amount of heat to the fabric. The curing step or steps may be conducted over a range of temperatures, between 100° and 200° C and for times varying from a few seconds to many minutes, in inverse proportion to the temperature of cure. The preferred curing conditions are those which limit excess of oxygen to the fabric with or without the presence of steam at temperatures in the range of 140°–200° C for a period of 0.5–5 minutes, and this may be preceded by an initial heat fixation step or treatment with or without limited access of oxygen to the fabric and with or without a steam atmosphere surrounding the fabric at 100°–130° C for a period of 1–10 minutes. After the final cure, the fabric may be stored in this stage or it may be converted into garments; the fabric may also be subjected to a process wash to remove small amounts of components which have not undergone fixation into the cellulosic fibers.

Products of this invention exhibit high levels of resilience as exemplified by conditioned recovery angles above 250° (warp plus fill), wet wrinkle recovery angles above 200° (warp plus fill), and durable press appearance ratings above 3.5 (scale 1 to 5, the later being the best rating), high levels of retention of strength as exemplified by retentions of breaking strength above 50% of that of the original fabric and retentions of tearing strength above 40% of that of the original fabric, high levels of retention of abrasion resistance as illustrated by retention of Stoll flex abrasion resistance above 40% and retention of Accelerotor abrasion resistance to the extent that weight is retained at levels above 90% (versus unmodified cotton at about 98%).

TESTING METHODS EMPLOYED

The following textile test methods were employed: durable press appearance ratings after 1 laundering and tumble-drying cycle by AATCC test method 124-1967, conditioned and wet wrinkle recovery angles with the Monsanto tester by ASTM D 1295-67, breaking strength and elongation by the strip (1 in.) method according to ASTM D 1682-64, tearing strength by ASTM D 1424-63, Stoll flex abrasion resistance by ASTM D 1175-55 T (b), and Accelerotor abrasion resistance by AATCC test method 93-1974. Antibacterial activity of fabrics was measured qualitatively by the Parallel Streak test according to AATCC 100-1965 and quantitatively by a modified Quinn test as described in *Applied Microbiology* 61, 74–78 (1962). Release of oily soil was measured by a modification of the method of Kissa as described in *Textile Chemists & Colorists* 3, 224–230 (1971). Specifically, a 0.1 ml sample of used motor oil was applied to the center of duplicate square swatches of fabric and was allowed to penetrate during a 16–24 hour period before the remainder of the procedure according to Kissa was carried out.

The essence of the present invention is the discovery that, as a result of impregnation of cellulosic fabrics with a mixture of water-soluble reagents, conventional di- or polyfunctional N-methylol reagents can be used to crosslink cotton simultaneously with, or subsequent to, in situ polymerization or insolublication of selected metal salts of acrylic-type monomers; that this can be accomplished by use of a single inorganic salt to catalyze the vinyl polymerization and the etherification reactions; and that the products exhibit improved retentions of strength and abrasion resistance at given levels of resilience together with antibacterial activity and amenability to release of oily soil. By controlling the amounts and proportions of the N-methylol reagent and polymerizable metal salt, the amount of persulfate initiator, and the conditions of cure, the performance qualities of the chemically-modified cotton fabric can be made to cover a wide range of attractive performance properties.

The following examples are provided to illustrate the preferred embodiments of the present invention. This is not meant to limit the scope of the invention in any manner whatever.

EXAMPLE 1

Cotton printcloth was impregnated to about 100% wet pickup with a solution containing 8% of dimethyloldihydroxyethyleneurea (DMDHEU), 0.8% of zinc nitrate hexahydrate, 0.1% of wetting agent (Tergitol TMN), and 2.0% of polyethylene softener (6.7% of Velvetol OE, 30% solids). Samples of fabric were placed on pin frames, dried at 70° C for 6 minutes and cured at 160° C for 3 minutes. The samples were laundered and tumble dried. The weight gain caused by reaction of DMDHEU was 5.1% and the nitrogen content of the fabric was 1.11%; less than 0.05% of zinc was found in the fabric. The fabric had a durable press (DP) appearance rating of 4.7 (on a scale of 1 to 5). Textile physical properties, release of oily soil, and antibacterial properties of this chemically modified cotton are summarized in Tables I, II, and III, respectively. By comparison to unmodified cotton printcloth, this product shows high resilience (DP rating and wrinkle recovery angle), substantially reduced strength (breaking strength and tearing strength), and drastically reduced abrasion resistance (Stoll flex and Accelerotor). The product also shows a large reduction in release of oily soil and moderate, but variable, antibacterial activity.

EXAMPLE 2

In the same manner as described in the preceding Example, cotton printcloth was treated with a solution containing 12% of solids of a commercial DMDHEU sold under the trade name Permafresh 114B (a modified DMDHEU for the purpose of improved retention of strength and abrasion resistance), 5% of Catalyst X-4 (modified zinc nitrate), 2.0% of polyethylene softener, and 0.1% of wetting agent. The weight gain from incorporation of reagent was 7.3% and the nitrogen content of the fabric was 1.33%. Only a trace of zinc was found in the fabric. The DP appearance rating of the fabric was 4.2. Data obtained on this chemically modified cotton are summarized in Tables I, II, and III. The performance properties of this chemically modified cotton are generally similar to those of the product described in Example 1 with the exception that the durable press rating is lower and retentions of strength and abrasion resistance are higher.

EXAMPLE 3

A reagent solution was prepared from 22.5 g methacrylic acid, 367.9 g water, 10.8 g zinc oxide, 1.14 g methylenebisacrylamide (MBA), 0.45 g wetting agent, 36.0 g DMDHEU, 9.0 g polyethylene softener, and 2.25 g $K_2S_2O_8$. Reagents were put together in the order indicated, care being taken to assure reaction of the zinc oxide with the methacrylic acid before addition of subsequent components. Twelve samples of printcloth were impregnated with this reagent solution to approximately 100% wet pickup. Each sample of fabric was placed on a pin frame and cured under the conditions described in Table IV. The conditions of curing varied in temperature, time, and presence or absence of oxygen. Data summarized in Table IV show that the weight gain of fabric due to reaction, the percentage of incorporated nitrogen, and the percentage of bound zinc varied substantially. In all cases, there is indication of reaction of DMDHEU, of which percent nitrogen constitutes a measure, and reaction of zinc methacrylate, of which percentage of zinc constitutes a measure. The highest levels of reaction of DMDHEU resulted in those cases that involved the high temperature cure. The highest incorporation of zinc methacrylate as an insolubilized network polymer resulted in those cases in which the curing reactions were conducted with an inert gas surrounding the fabric. The highest DP appearance rating was realized from a cure at the higher temperature in the presence of oxygen.

EXAMPLE 4

An aqueous solution was prepared to contain 8% DMDHEU, 2% polyethylene softener, 0.1% wetting agent, and 0.5% $K_2S_2O_8$. Cotton printcloth was impregnated with this reagent to the level of approximately 87% and the damp fabric was placed on pin frames that were inserted into heat-resistant plastic bags, and each bag was subjected to 10 minutes at 120° C and then to 5 minutes at 160° C in forced-draft ovens. The fabric was laundered and tumble dried. The weight gain due to reaction of reagents with cotton was 3.7% and the incorporation of nitrogen in the fabric was 0.90%. The DP appearance rating of the fabric was 4.0. Textile physical properties for this product are summarized in Table I. With small variations, this product is generally similar to those from Examples 1 and 2.

EXAMPLE 5

An aqueous reagnet solution was prepared to contain 5% methacrylic acid, 0.25% MBA, 0.1% wetting agent, 8% DMDHEU, 2% polyethylene softener, 0.5% $K_2S_2O_8$. Cotton fabric was impregnated in this solution to obtain a wet pickup of approximately 90% and the damp fabric was placed on pin frames. Each pin frame was placed in a heat-resistant plastic bag which was flushed with nitrogen and sealed. Each plastic bag was heated at 120° C for 10 minutes and 160° C for 5 minutes in forced-draft ovens. The laundered and tumble-dried fabric showed a weight gain of 4.8% and the nitrogen content of the fabric was 0.84%. The DP appearance rating was 4.2. On the basis of weight gain and by comparison of the corresponding value in Example 4, it is indicated that very little methacrylic acid was insolubilized in the form of a network polymeric structure.

EXAMPLE 6

An aqueous reagent solution was prepared to contain 7.5% acrylic acid, sufficient sodium hydroxide to form the sodium salt of acrylic acid, 0.25% MBA, 0.1% wetting agent, 8% DMDHEU, 2% polyethylene softener, and 2% $Na_2S_2O_8$. Cotton fabric was impregnated in this reagent solution and thereafter handled in the same manner as described in Example 4. The weight gain due to reaction was 8.1%, but the nitrogen content of the fabric was 0.3% and the DP rating was 1. Thus, no resilience was developed and little of the DMDHEU was reacted with fabric in this case.

EXAMPLE 7

A reagent solution was prepared to contain 8% DMDHEU, 8% acrylic acid, 12.1% zinc acetate, 0.25% MBA, 0.1% wetting agent, and 0.5% $K_2S_2O_8$. Cotton fabric was impregnated with this reagent solution to a wet pickup of approximately 115%. Samples were placed on pin frames inside heat-resistant plastic bags which were flushed with nitrogen and sealed. One set of samples (a) was heated 120° C for 10 minutes in forced-draft oven; the other set of samples (b) was heated at 160° C for 8 minutes. After extensive rinsing in hot-running tap water and line drying, the following results were obtained: (a) weight increase from reaction 19.8%, zinc incorporated into fabric 1.46%; (b) weight increase 11.8%, zinc incorporated into fabric 0.82%, nitrogen bound in fabric 1.10%. These results show that substantial reactions of each of the reagents occurred. Textile data are summarized in Table I.

EXAMPLE 8

In this experiment, acrylic acid was reacted with zinc carbonate to form zinc acrylate prior to addition of the other components. The reagent systems was prepared to contain 8% acrylic acid, 6.9% zinc carbonate, 0.25% MBA, 8% DMDHEU, 2% polyethylene softener, 0.1% wetting agent, and 0.5% $K_2S_2O_8$. Samples of fabric that were impregnated with this reagent solution to wet pickups of approximately 110% were placed on pin frames in heat-resistant plastic bags that were flushed with nitrogen and sealed. In these bags, fabrics were subjected to 3 different curing conditions: (a) 120° C for 10 minutes followed 160° C for 5 minutes, (b) 120° C for 10 minutes followed by removal from bag and 160° C for 5 minutes, and (c) at 160° C for 15 minutes. The samples of fabric were rinsed extensively in hot-running tap water and line dried. Weight increases due to reaction of reagents were (a) 22.2%, (b) 23.6%, and (c) 21.7%; the DP appearance ratings for these 3 samples were 4.2, 4.5, and 4.3, respectively. The textile performance properties are summarized in Table I. In all three cases attractive levels of resilience and Accelerotor abrasion resistance were obtained. Sample (a) was tested and found to be 100% effective against *S. epidermidis* in the modified Quinn test.

EXAMPLE 9

An equivalent of zinc carbonate was added to acrylic acid in dilute solution to obtain a solution of zinc acrylate. From this solution and other ingredients, there was prepared an aqueous solution containing 1% acrylic acid, 0.9% zinc carbonate, 0.25% MBA, 8% DMDHEU, 2% polyethylene softener, 0.1% wetting agent, and 0.5% $K_2S_2O_8$. Samples of fabric were impregnated to wet pickups of approximately 110% and were handled in the same manner as described in Example 8. The weight gains due to reactions of reagents were (a) 14.7%, (b) 15.1%, and (c) 14.0%. The DP appearance ratings were 4.9, 4.9, and 4.5, respectively. Textile performance properties of these samples are summarized in Table I. Sample (a) was tested for antibacterial properties against *S. epidermidis* in the modified Quinn test and found to be 70% effective in reducing growth of colonies of bacteria.

EXAMPLE 10

An equivalent of zinc carbonate was added to acrylic acid in dilute solution to obtain a solution of zinc acrylate. From this solution and other ingredients, there was prepared an aqueous solution containing 1% acrylic acid, 0.9% zinc carbonate, 0.25% MBA, 8% DMDHEU, 2% polyethylene softener, 0.1% wetting agent, and 0.5% $K_2S_2O_8$. Cotton printcloth was impregnated in this reagent solution to a wet pickup of approximately 105%. The wet fabric was placed on pin frames in heat-resistant plastic bags that were flushed with nitrogen. The samples of fabrics in the bags were subjected to heating in forced-draft ovens at 120° C for 10 minutes, immediately followed by 160° C for 5 minutes. The samples of fabric were washed extensively in hot running tap water and line dried. The weight gain due to add-on of reagent was 7.1%; the nitrogen incorporated into the fabric was 0.88% and the zinc incorporated was 0.39%. The DP appearance rating was 3.1. Textile properties are summarized in Table I and antibacterial properties are summarized in Table III.

EXAMPLE 11

In the manner described in Example 10 a reagent solution was prepared to contain all of the same ingredients with the exception of the amount of acrylic acid was raised to 3% and the zinc carbonate employed to form zinc acrylate was raised to 2.7%. Samples of printcloth were treated with this reagent solution in the manner described in Example 10 with the result that weight gain of fabric was found to be 11.4%; the amounts of bound nitrogen and bound zinc were measured as 0.87% and 0.94%, respectively. The DP appearance rating of the fabric was 3.6. Textile properties are summarized in Table I and antibacterial performance are summarized in Table III.

EXAMPLE 12

In this case, the acrylic acid content of the reagent solution was raised to 5% and the zinc carbonate employed to convert it to zinc acrylate amounted to 4.4% of the final solution, which contained the other ingredients in the same amounts as indicated in Example 10. Cotton printcloth was impregnated with this reagent solution to a wet pickup of approximately 110% and the fabric was subjected to the same treatments as described in Example 10. The results were as follows: weight gain from reaction of reagents was 16.1%; incorporation of nitrogen was 0.89%; and incorporation of zinc was 1.70%. The DP appearance rating of the fabric was 3.9. Textile properties are summarized in Table I. Release of oily soil is summarized in Table II. Antibacterial properties are summarized in Table III.

EXAMPLE 13

In the manner described in Example 10, an aqueous reagent solution was prepared containing the same components with the exception that methacrylic acid replaced acrylic acid and zinc oxide replaced zinc carbonate. The amounts of these two components in the final reagent solution amounted to 1% and 0.48%, respectively. Cotton printcloth was treated with this solution to obtain wet pickups of approximately 105%. The curing conditions and other operations were those described in Example 10. The results were as follows: weight gain from reagents 6.0%; bound nitrogen 0.83%; bound zinc 0.28%; and DP appearance rating 4.0. Textile properties are summarized in Table I and antibacterial properties in Table III.

EXAMPLE 14

In this experiment, cotton printcloth was treated with the reagent system similar to that described in Example 11 with the exception that 3% of acrylic acid was replaced with the same amount of methacrylic acid and the zinc carbonate was replaced with 1.45% zinc oxide. The results were as follows: weight gain due to reaction 8.6%; bound nitrogen 0.86%; bound zinc 0.68%; and DP appearance rating 3.8. Textile properties are summarized in Table I and antibacterial properties in Table III.

EXAMPLE 15

Cotton printcloth was reacted with a reagent solution identical to that described in Example 12 with the exception that acrylic acid was replaced with methacrylic acid and the zinc carbonate was replaced with 2.4% zinc oxide. The operation and procedure were the same as that described in Example 12. The results were: weight gain from reaction 13.1%; bound nitrogen 0.83%; bound zinc 1.35%; and DP appearance rating 3.8. Textile properties are summarized in Table I, release of oily soil in Table II and antibacterial properties in Table III.

EXAMPLE 16

In the manner described in Example 10, cotton printcloth was reacted with a reagent solution identical to that of Example 10 with the exception that acrylic acid was replaced with methacrylic acid and zinc carbonate was replaced with 0.32% zinc oxide. The results were: weight gain of fabric 7.8%; bound nitrogen 0.89%; bound zinc 0.19%; and DP appearance rating 4.5. Textile properties are summarized in Table I and antibacterial performance in Table III.

EXAMPLE 17

This example was conducted in the same manner as Example 11 and the reagent solution was that described in Example 11 with replacement of the acrylic acid with 3% itaconic acid and replacement of zinc carbonate with 0.72% zinc oxide. The results were: weight gain due to reaction 9.1%; bound nitrogen 1.15%; bound zinc 0.33%; and DP appearance rating 4.4. Textile properties are summarized in Table I and antibacterial properties in Table III.

EXAMPLE 18

In the manner described in Example 12, a reagent solution was prepared to contain the same reagents except that the acrylic acid was replaced with 5% itaconic acid and the zinc carbonate was replaced with 1.6% zinc oxide. The wet pickup of fabric was approximately 112%. All operations were the same as those described in Example 12. The results were: weight gain due to reaction 11.2%; bound nitrogen 1.1%; bound zinc 0.60%; and DP appearance rating 4.4. Textile properties are summarized in Table I, oily soil release in Table II, and antibacterial properties in Table III.

Explanatory Comments on the Examples

Examples described above illustrate the following points:

| Example No. | Point Illustrated |
|---|---|
| 1 | Conventional durable-press cotton fabric based on pure reagent |
| 2 | Conventional durable-press cotton fabric based on commercial reagent modified for superior retentions and abrasion resistance |
| 3 | Effects of variations in curing conditions for experimental modifications of cotton |
| 4 | Catalysis of DMDHEU reaction with persulfate in place of conventional catalyst |
| 5-6 | Experimental variations yielding inadequate degrees of reaction |
| 7 | Illustration of the effect of curing conditions |
| 8-9 | Illustrations of effects of curing conditions and variations in the reagent system |
| 10,13,16 | Illustrations of the effects resulting from introduction of low concentrations of zinc salts of polymerizable monomers into the reagent system |
| 11,13,17 | Effect of introduction of slightly higher concentrations of zinc salts of polymerizable monomers into the reagent system |
| 12,15,18 | Effects of introduction of moderate amounts of zinc salts of polymerizable monomers into the reagent system |

In Examples 3, 7-9, it is shown that nitrogen, indicative of residues of DMDHEU, and zinc, indicative of residues of zinc salt of polymerizable monomers, are insolubilized in cotton fibers under a variety of conditions. Optimum conditions for fixing zinc are those which involving moderate to high temperature and an inert atmosphere. The optimum conditions for binding nitrogen are those involving high temperature.

The purpose of the invention is illustrated most effectively by by comparison of results from Examples 10–18 with those of 1, 2, 4–6, the latter including representatives of conventional DP cotton. An examination of textile physical properties for Examples 10–18 (Table I) shows that a range of levels of DP appearance rating from low (3.1) to high and attractive (4.5) can be obtained in the experimental compositions. Furthermore, the comparison of levels of retained strength and abrasion resistance for these experimental samples to the corresponding results from Examples 1, 2, and 4 illustrate superior retentions of strength and abrasion resistance for the product containing polymerized zinc monomers. The superiority is most notable in connection with abrasion resistance, particularly Stoll flex abrasion resistance.

The very attractive release of oily soil which characterizes the products of this invention (Examples 10–18) is evident in data summarized in Table II. Results obtained on the experimental compositions exhibit very substantially higher percentage of release of soil at the end of 1 laundering cycle or 5 laundering cycles. Furthermore, this ability to release soil is durable as shown by the results of soiling cotton after 10 launderings were carried out prior to the soiling operation. In this case the multiply-laundered samples exhibited as attractive soil release as the initial samples. The soil release performance of the experimental composition involving zinc acrylate approached very closely to the attractive soil release of unmodified cotton, itself. The improved soil release of the experimental samples is particularly evident when comparison is made to the oily soil release properties of conventional DP cotton.

Conventional DP cotton exhibits some highly variable antibacterial activity, due apparently to the release of formaldehyde from the chemically-reacted DMDHEU in the cotton fabric. However, this activity is only moderate and is quite variable. Results were poorly reproducible and for this reason are not included. From data in Table III on the experimental compositions, it is evident that antibacterial activity towards *S. aureus* and *A coli* was durable through 25 launderings. Although durability dropped off after 50 launderings, some of the samples passed even at this time. In the modified Quinn test, samples passed the test through 50 launderings and drying cycles; in this test a value above 75% is considered very good.

Overall, results show that retentions of strength and abrasion resistance are not critically dependent upon the concentrations of zinc bound into the cotton fabric. Antibacterial performance is effective, reproducible, and durable even for low levels of zinc found in the fabric. Release of oily soil appears to be more dependent upon the type of zinc salt than upon the level of salt, the zinc acrylate showing the highest level of release of oily soil.

Table I

Textile physical properties of chemically modified cotton printcloth.

| Example No. | DP Rating | Wrinkle Recovery Angle[a] Conditioned | Wet | Breaking Strength[b] | Tearing Strength[b] | Stoll Flex Abrasion[b] | Accelerotor Abrasion[c] |
|---|---|---|---|---|---|---|---|
| (Unmodified cotton) | 1.4 | 189 | 166 | 100 | 100 | 100 | 97.4 |
| 1 | 4.7 | 303 | 251 | 42 | 48 | 6 | 78.5 |
| 2 | 4.2 | 305 | 249 | 51 | 53 | 28 | 80.6 |
| 4 | 4.0 | 291 | 246 | 49 | 63 | 24 | 91.8 |
| 7a | — | 215 | 188 | — | 53 | 15 | |
| 7b | — | 276 | 257 | — | 31 | 7 | |
| 8a | 4.2 | 263 | 195 | — | — | 58 | 96.5 |
| 8b | 4.5 | 269 | 212 | — | — | 42 | 93.3 |
| 8c | 4.3 | 269 | 224 | — | — | 26 | 94.5 |
| 9a | 4.9 | 308 | 276 | — | — | 8 | 83.9 |
| 9b | 4.9 | 310 | 281 | — | — | 5 | 77.8 |
| 9c | 4.5 | 303 | 272 | — | — | 6 | 78.1 |
| 10 | 3.1 | 276 | 250 | 62 | 45 | 75 | 93.9 |
| 11 | 3.6 | 268 | 215 | 64 | 45 | 73 | 94.3 |
| 12 | 3.9 | 262 | 227 | 61 | 40 | 78 | 94.3 |
| 13 | 4.0 | 266 | 220 | 64 | 50 | 95 | 97.7 |
| 14 | 3.8 | 271 | 212 | 64 | 49 | 109 | 96.7 |
| 15 | 3.8 | 251 | 194 | 62 | 48 | 121 | 97.7 |
| 16 | 4.5 | 295 | 256 | 53 | 58 | 45 | 94.7 |
| 17 | 4.4 | 293 | 270 | 54 | 58 | 52 | 93.0 |
| 18 | 4.4 | 297 | 279 | 54 | 58 | 35 | 89.7 |

[a]Degrees, warp + fill.
[b]Percent retained relative to unmodified cotton printcloth.
[c]Percent weight retained after 5 minutes at 3000 rpm with 250 grit Emery paper liner.

Table II

Release of oily soil from chemically modified cotton printcloth.

| Example No. | Percentage Release of Soil from Initial Fabric After 1 laundering | After 5 launderings | Percentage Release of Soil from Multiple Laundered Fabric[a] After 1 laundering | After 5 launderings |
|---|---|---|---|---|
| Unmodified cotton | 87.9 | 97.7 | 92.8 | 98.7 |
| 1 | 5.9 | 35.8 | 20.7 | 49.0 |
| 2 | 7.0 | 32.0 | 17.4 | 42.9 |
| 12 | 25.7 | 95.2 | 85.2 | 94.8 |
| 15 | 21.7 | 60.6 | 52.9 | 74.5 |
| 18 | 21.9 | 63.0 | 55.7 | 71.1 |

[a]The fabric was laundered through 10 cycles prior to the soiling test.

Table III

Performance of chemically modified cotton printcloth in antibacterial tests.

| Example No. | Parallel Streak Test[a] After 25L | After 50L | Modified Quinn Test[b] After 1L | After 25L | After 50L |
|---|---|---|---|---|---|
| (Unmodified | | | | | |

Table III-continued

| Example No. | Performance of chemically modified cotton printcloth in antibacterial tests. Parallel Streak Test[a] After 25L | After 50L | Modified Quinn Test[b] After 1L | After 25L | After 50L |
|---|---|---|---|---|---|
| cotton) | 0 | 0 | 0 | 0 | 0 |
| 1 | (variable) | (variable) | (variable) | (variable) | (variable) |
| 2 | (variable) | (variable) | (variable) | (variable) | (variable) |
| 10 | P | — | 100 | 100 | — |
| 11 | P | P− | 100 | 100 | 82 |
| 12 | P + 1 | P | — | — | — |
| 13 | P | P− | 100 | 100 | 90 |
| 14 | P | P | — | — | — |
| 15 | P + 1 | — | — | — | — |
| 16 | P | P | 100 | 100 | 97 |
| 17 | P | P | — | — | — |
| 18 | P + 1 | P− | — | — | — |

[a]Tests were made against *S. aureus* and *E. coli* after 25 laundering and tumble drying cycles (L) and after 50 such cycles; P = pass; a − following the P indicates a narrower than usual zone of inhibition and a + 1 indicates wider than normal zone of inhibition.
[b]Tests were made against *S. epidermidis* after 1, 25, or 50 laundering and tumble drying cycles (1).
[c]These results were generally low and extremely variable, due perhaps to formaldehyde release from the finish (ref. Gagliardi).

Table IV

Effects of variations in fixation (at 120°) and cure (at 160°).

| Ex. No. | Curing Conditions | Weight Gain % | Bound Nitrogen % | Bound Zinc % | DP Appearance Rating |
|---|---|---|---|---|---|
| 3a | 120° C, 10 minutes nitrogen atmosphere | 8.6 | 0.25 | 0.58 | 1.9 |
| 3b | 120° C, 10 minutes in air | 3.6 | 0.46 | 0.22 | 2.5 |
| 3c | 120° C, 10 minutes 160° C, 5 minutes nitrogen atmosphere | 10.0 | 0.88 | 0.64 | 2.8 |
| 3d | 120° C, 10 minutes 160° C, 5 minutes in air | 7.5 | 1.02 | 0.33 | 3.7 |
| 3e | 160° C, 15 minutes nitrogen atmosphere | 11.5 | 1.02 | 0.48 | 3.7 |
| 3f | 160° C, 15 minutes in air | 7.5 | 0.98 | 0.28 | 4.3 |

We claim:

1. A process for imparting a plurality of useful properties to cellulosic fabrics, said properties including wrinkle resistance, soil release, improved breaking strength and abrasion, and durable deodorant (bacteriostatic) quality to textile garments, the process comprising:

(a) impregnating cotton or other cellulose containing fabric with an aqueous solution containing
  (1) at least one water-soluble polyfunctional cross-linking compound having a methylol group,
  (2) at least one zinc-containing compound, the salt of a polymerizable acrylic-type acid, and
  (3) at least one water-soluble basic persulfate initiator;

(b) subjecting the impregnated fabric to a heat-fixation treatment, and (c) curing the fabric of (b).

2. The process of claim 1 wherein the methylol cross-linking compound is selected from the group consisting of
  formaldehyde,
  dimethylolethyleneurea,
  dimethylolpropyleneurea,
  bis(methyoxymethyl)uron,
  tris(methyoxymethyl)urea,
  dimethyloltriazone,
  dimethyloldihydroxyethyleneurea,
  highly methylated, fully-methylolated melamine,
  dimethylolmethylcarbamate,
  dimethylolalkylcarbamates, and
  partially-methylated trimethylol melamine.

3. The process of claim 1 wherein the zinc-containing compound is selected from the group consisting of a water-soluble zinc salt of a vinylpolymerizable carboxylic acid selected from the groups consisting of
  acrylic acid,
  methacrylic acid, and
  itaconic acid.

4. The process of claim 1 wherein the persulfate initiator is selected from the group consisting of
  ammonium persulfate,
  sodium persulfate, and
  potassium persulfate.

5. The process of claim 1 wherein the heat fixation temperatures are about from 100° to 130° C for about from 1 to 10 minutes.

6. The process of claim 1 wherein the curing temperatures are about from 140° to 200° C for about from 0.5 to 5 minutes.

* * * * *